US007954209B2

(12) United States Patent
Chen

(10) Patent No.: US 7,954,209 B2
(45) Date of Patent: Jun. 7, 2011

(54) WATERPROOF STRUCTURE FOR ZIPPERS

(75) Inventor: Hung-Chao Chen, Kaohsiung (TW)

(73) Assignee: Best-Win International Co., Kaohsiung (TW)

( * ) Notice: Subject to any disclaimer, the term of this patent is extended or adjusted under 35 U.S.C. 154(b) by 831 days.

(21) Appl. No.: 11/964,459

(22) Filed: Dec. 26, 2007

(65) Prior Publication Data

US 2009/0165265 A1 Jul. 2, 2009

(51) Int. Cl.
*A44B 19/32* (2006.01)

(52) U.S. Cl. ..... 24/389; 29/408; 29/410; 264/252; 24/403; 24/405

(58) Field of Classification Search ..... None
See application file for complete search history.

(56) References Cited

U.S. PATENT DOCUMENTS

| | | | | |
|---|---|---|---|---|
| 2,989,444 | A * | 6/1961 | Cohn | 29/408 |
| 3,939,547 | A * | 2/1976 | Bernier et al. | 29/408 |
| 4,325,982 | A * | 4/1982 | Gillette et al. | 427/461 |
| 2006/0059675 | A1 * | 3/2006 | Hsieh | 29/408 |

* cited by examiner

*Primary Examiner* — Robert J Sandy

(57) ABSTRACT

A waterproof structure for zippers includes a waterproof layer formed on one side surface of two tapes of a half-finished zipper. The waterproof layer is formed by coating a layer of bonding glue on the one side surface of the two tapes and then the bonding glue has its upper layer stuck with an electroplating membrane. By so designing, external water can be prevented from seeping in the two tapes of the zipper, thus elevating waterproof effect of a zipper.

6 Claims, 4 Drawing Sheets

WATERPROOF STRUCTURE FOR ZIPPERS

BACKGROUND OF THE INVENTION

1. Field of the Invention

This invention relates to a waterproof structure for zippers, particularly to one provided with a waterproof layer on one side surface of two zipper tapes for preventing water from seeping in the two zipper tapes.

2. Description of the Prior Art

Zippers are widely used for clothes, handbags sports equipment, raincoats diving suits and the like. Apart from having a closing and unclosing function, zippers are expected to have other practical properties among which water resistance is of great importance.

However, conventional zippers cannot effectively resist water because zipper tapes of the conventional zippers are made of fabric; therefore, external water is easy to seep in the zipper tapes, always causing inconvenience in use. In view of this drawback, the zipper tapes of the conventional zipper are coated with PU colloidal membrane for increasing waterproof effect, but actually PU colloidal membrane is not good in weather resistance and unable to resist high temperature for long, and hence, after used and contacting with water for a period of time, the PU colloidal membrane will gradually cause hydrolysis and fall off.

SUMMARY OF THE INVENTION

The objective this invention is to offer a waterproof structure for zippers for effectively bettering the waterproof function of conventional zippers and elevating waterproof effect for clothes or packages.

The waterproof structure for zippers in the present invention includes two zipper tapes, two toothed bars respectively fixed at the opposite inner edges of the two zipper tapes, and a waterproof layer provided on one side surface of the two zipper tapes. The waterproof layer is formed by applying a layer of bonding glue to one side surface of the zipper tapes and then the bonding glue is stuck thereon with an electroplating membrane. Thus, external water can be prevented from seeping in the zipper tapes.

The waterproof structure for zippers in the present invention has the following advantages.

1. The zipper waterproof layer composed of the electroplating membrane with high molecular density can effectively block off water and is applicable to any zipper used in waterproof clothes and packages. In addition, the electroplating membrane has excellent weather-resisting and corrosion-resisting properties, able to bear high temperature and resist acid or alkaline substance and impossible to cause hydrolysis. Therefore, the zipper waterproof layer bonded with the electroplating membrane is applicable to zippers of clothes or articles, which are to be used in special conditions, able to prolong its service life.

2. The electroplating membrane includes metal ion to enable the surface of the zipper to present dazzling metal luster.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
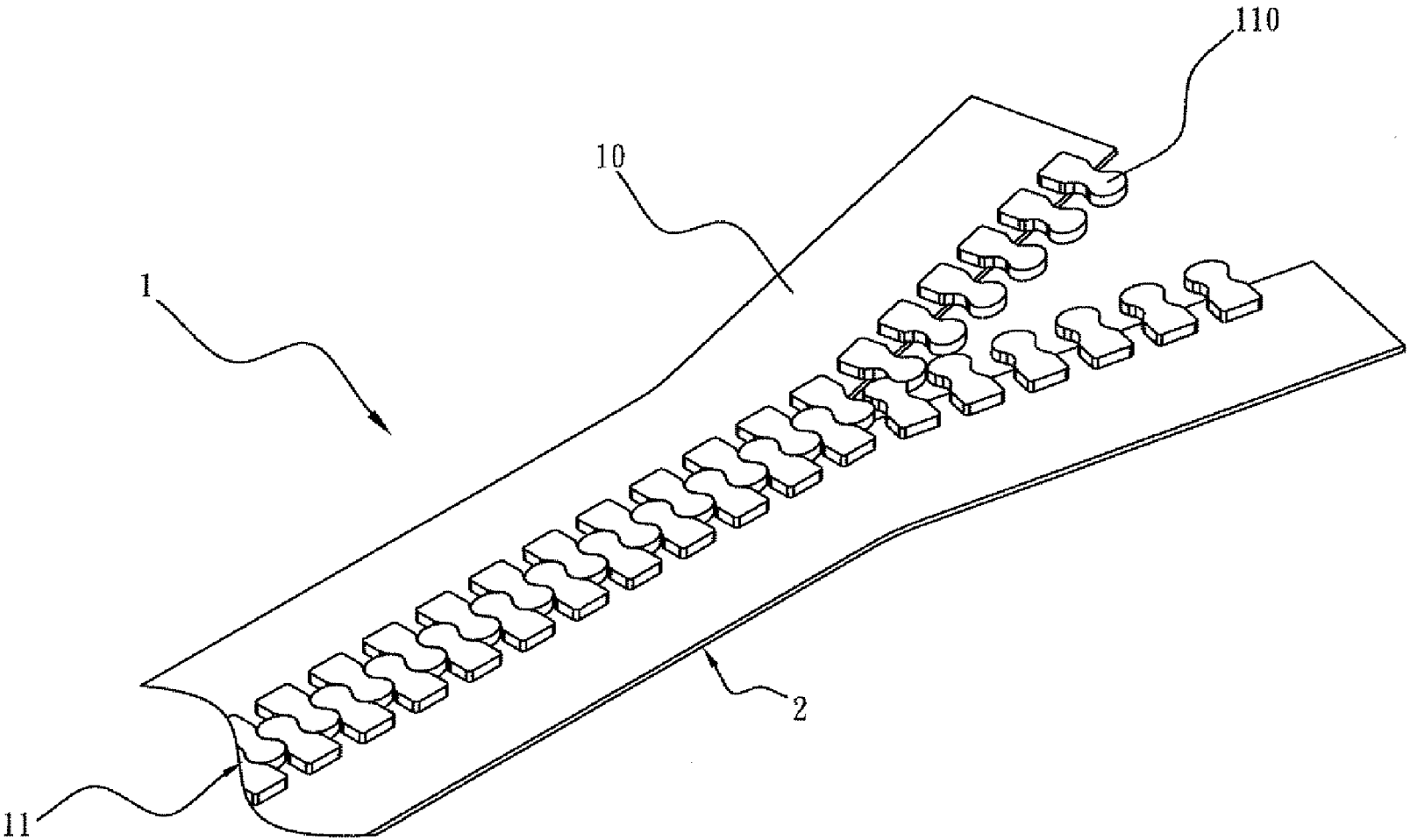
FIG. 1 is a perspective view of a zipper with a waterproof structure in the present invention.
Figure 2:
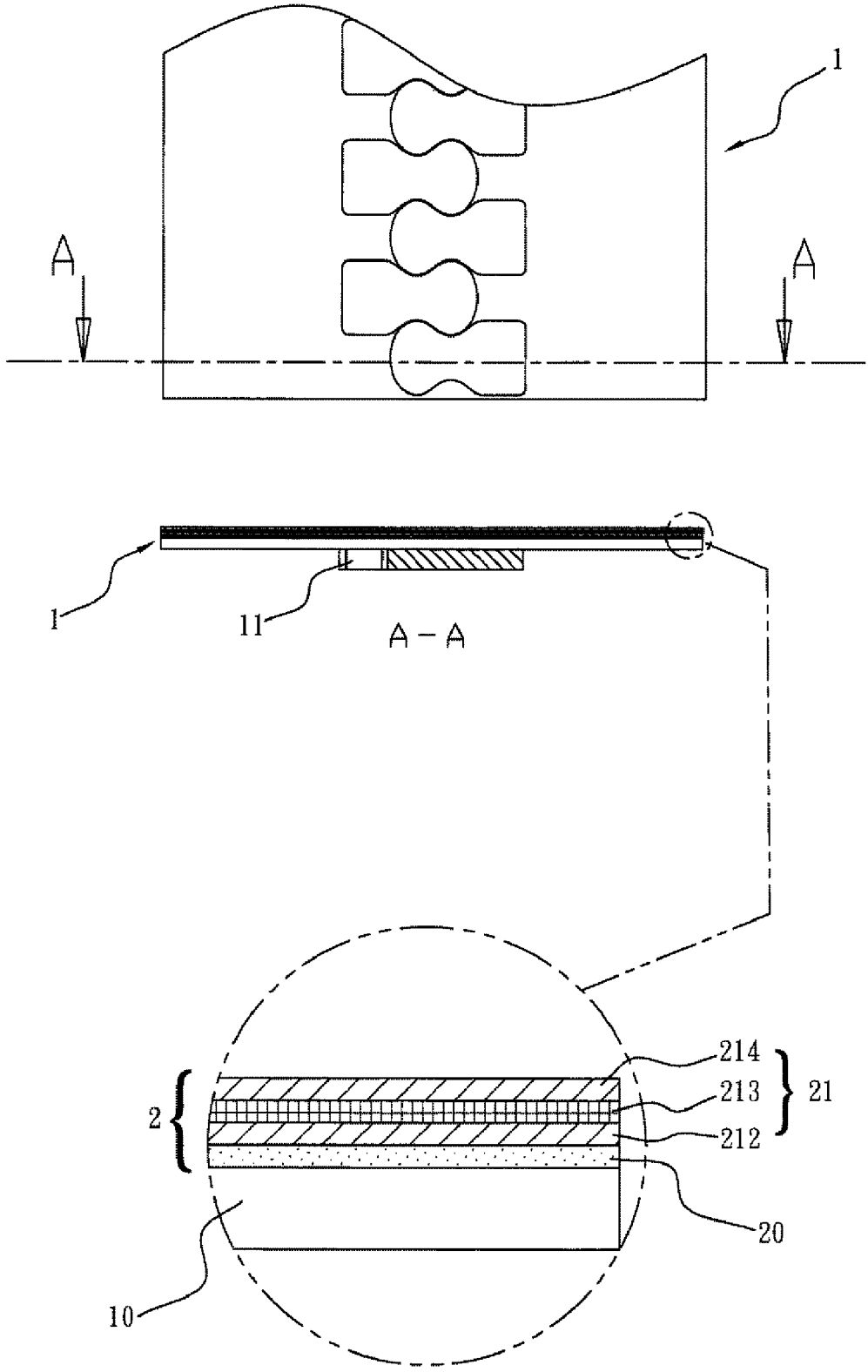
FIG. 2 is a partial cross-sectional view of a waterproof layer of the zipper in the present invention.

A preferred embodiment of a waterproof structure for zippers in the present invention, as shown in FIGS. 1 and 2, includes a half-finished zipper 1 that is not yet provided thereon with a pull tab. The half-finished zipper 1 consists of two tapes 10 and two toothed bars 11 respectively fixed at the two opposite inner side edges of the two tapes 10. The two toothed bars 11 are respectively disposed with teeth 110 arranged at proper intervals to be engaged mutually for closing the zipper.

Figure 3:
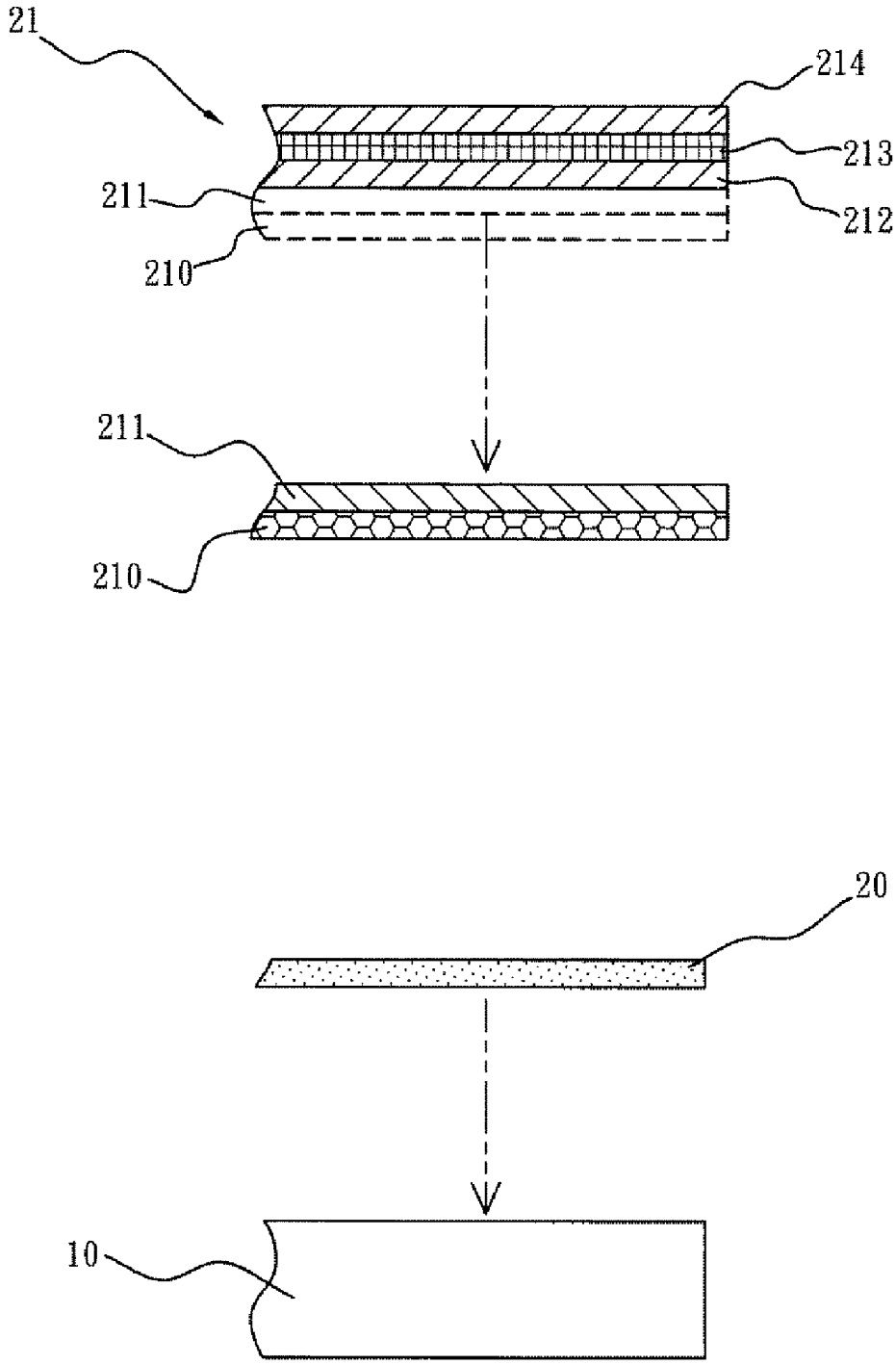
FIG. 3 is a cross-sectional view of the steps of sticking an electroplating membrane to the tapes of the zipper in the present invention.
Figure 4:
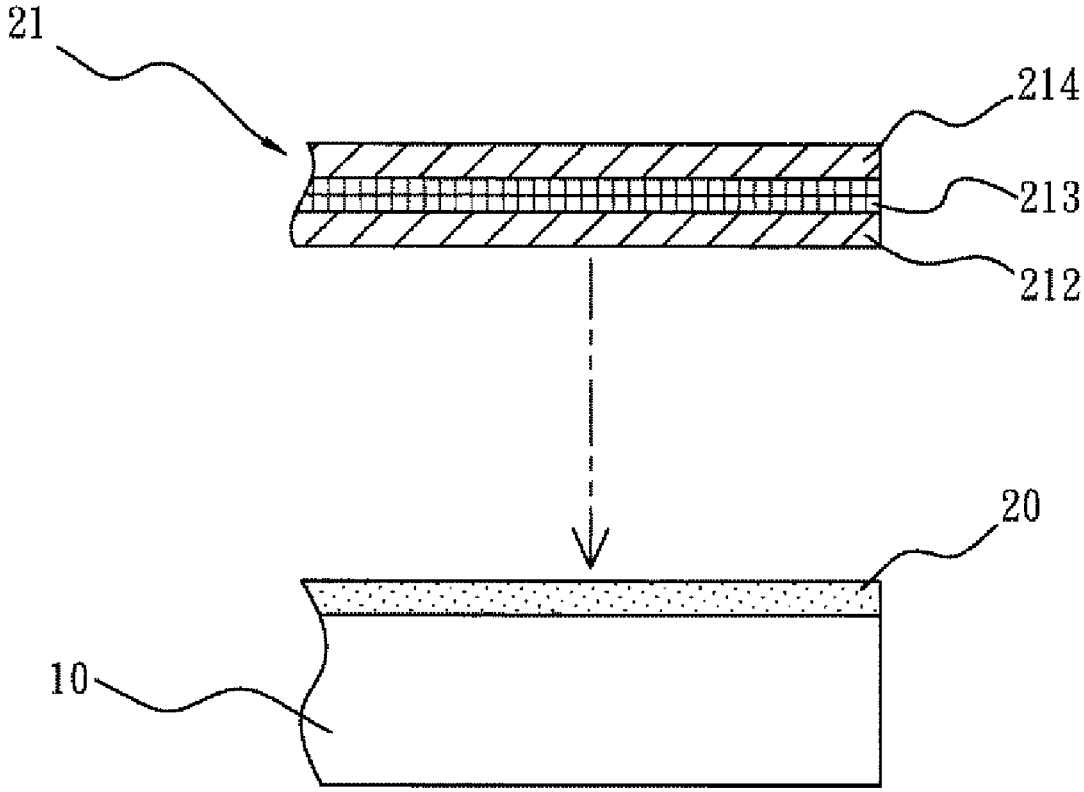
FIG. 4 is another cross-sectional view of the electroplating membrane to be bonded on the tapes of the zipper in the present invention.

Referring to FIGS. 2, 3 and 4, the tapes 10 have one side surface coated with bonding glue 20, and then an electroplating membrane 21 is stuck to the upper layer of the bonding glue 20 to form a waterproof layer 2 on the surface of the tapes 10 for preventing external water from seeping in the tapes 10. The electroplating membrane 21 is provided with a substratum layer 210 made of high molecule polyester, and an interface layer 211, which could be a dissociating agent, coated on the substratum layer 210. Afterward, the interface layer 211 is coated thereon with a first protecting colloid layer 212, which then has its topside electro-plated with metal powder, such as aluminum powder, to form an electroplated layer 213. Subsequently, the electroplated layer 213 is coated thereon with a second protecting colloid layer 214 to make up a complex layer with the electroplating membrane 21.

The steps of forming the waterproof layer 2 on one side surface of the two tapes 10 of the half-finished zipper 1 are described as follows.

A first step is inputting material. The half-finished zipper 1 is guided to a processing line to be processed;

A second step is coating of bonding glue. The bonding glue 20 is evenly coated on one side surface of the two tapes 10 of the half-finished zipper 1 by means of a roller unit;

A third step is gluing of electroplating membrane. The electroplating membrane 21 has both its interface layer 211 and its substratum layer 210 removed and then has its first protecting colloid layer 212 closely bonded with the bonding glue 20 on the surface of the tapes 10;

A fourth step is drying. The half-finished zipper 1 having its surface stuck with bonding glue 20 and electroplating membrane 21 is conveyed to a roaster oven to be roasted for drying the bonding glue 20 and the electroplating membrane 21. The roasting time of the roaster oven is set in accordance with the amount of the bonding glue 20 coated on the surface of the tapes 10;

A fifth step is hot pressing and shaping. The bonding glue 20 and the electroplating membrane 21 on the surface of the tapes 10 of the half-finished zipper 1 are pressed by a hot-pressing device for bonding them together and shaping them. The temperature of the hot-pressing device is 80° C. to 220° C. and the output pressure of the hot-pressing device is preferably 0.5 to 12 kg/cm$^2$.

A sixth step is drying. After the bonding glue 20 and the electroplating membrane 21 on the surface of the half-finished zipper 1 are pressed by the hot-pressing device, the half-finished zipper 1 is conveyed to the roaster oven to be roasted and dried again;

A seventh step is keeping static for maturity. The half-finished zipper 1 is cooled off by a fan or by natural wind and then kept static to let the bonding glue 20 thereon have sufficient time to be matured for reinforcing combination of the tapes 10 with the electroplating membrane 21. Time of keeping static for maturity is preferably above 6 hours; and An eighth step is moving-out of products. After the waterproof layer is formed on the surface of the tapes 10, the half-finished zipper 1 is moved out of the processing line.

In addition, the electroplating membrane 21 has its substratum layer 210 plated with metal ion; therefore, when the waterproof layer 2 of the half-finished zipper 1 is shaped, the electroplating membrane 21 will produce metal luster to increase external beauty of the zipper.

While the preferred embodiment of the invention has been described above, it will be recognized and understood that various modifications may be made therein and the appended claims are intended to cover all such modifications that may fall within the spirit and scope of the invention.

I claim:

1. A waterproof structure for zippers, comprising two tapes and two toothed bars, said two toothed bars respectively fixed at opposite inner side edges of said two tapes, said two tapes having one side surface applied with bonding glue, said bonding glue having its topside closely stuck with an electroplating membrane for preventing external water from seeping in said tapes.

2. The waterproof structure for zippers as claimed in claim 1, wherein said waterproof structure is formed by:

a first step of inputting material;

a second step of applying bonding glue, said bonding glue evenly applied to one side surface of said two tapes of a half-finished zipper by a roller unit;

a third step of gluing said electroplating membrane; said electroplating membrane closely stuck to a superficial layer of said bonding glue;

a fourth step of drying; said half-finished zipper with said bonding glue and said electroplating membrane on its surface conveyed to a roaster oven to be roasted and dried;

a fifth step of hot pressing and shaping, said bonding glue and said electroplating membrane on a surface of said tapes of said half-finished zipper pressed and closely bonded together by a hot-pressing device;

a sixth step of drying for a second time; said half-finished zipper, after pressed, conveyed to a roaster oven to be roasted and dried again;

a seventh step of keeping static for maturity; said half-finished zipper cooling off and then kept static to let said bonding glue of said half-finished zipper matured; and an eighth step of moving-out of products.

3. The waterproof structure for zippers as claimed in claim 2, wherein a time of roasting carried out in said fourth step of drying is set according to an amount of said bonding glue and said electroplating membrane applied on said tapes.

4. The waterproof structure for zippers as claimed in claim 2, wherein a hot pressing temperature in said fifth step of hot pressing and shaping is 80° C. to 220° C.

5. The waterproof structure for zippers as claimed in claim 2, wherein an output pressure needed in said fifth step of hot pressing and shaping is 0.5 to 12 kg/cm$^2$.

6. The waterproof structure for zippers as claimed in claim 2, wherein a time of keeping static for maturity needed in said seventh step is above 6 hours.

* * * * *